US005608182A

United States Patent [19]

Thompson et al.

[11] Patent Number: 5,608,182

[45] Date of Patent: Mar. 4, 1997

[54] FUEL GAS GENERATOR FOR AIRBREATHING PROPULSION SYSTEMS

[75] Inventors: Darren M. Thompson, Madison; William M. Chew, Huntsville, both of Ala.

[73] Assignee: The United States of America as represented by the Secretary of the Army, Washington, D.C.

[21] Appl. No.: 641,138

[22] Filed: Apr. 22, 1996

[51] Int. Cl.[6] ..... C06B 27/00

[52] U.S. Cl. ..... 149/22; 149/6; 149/19.4; 149/19.7; 149/61

[58] Field of Search ..... 149/22, 6, 19.7, 149/61, 19.4

[56] References Cited

U.S. PATENT DOCUMENTS

| | | | |
|---|---|---|---|
| 3,948,699 | 4/1976 | Ayers et al. | 149/22 |
| 4,061,512 | 12/1977 | Chew et al. | 149/22 |
| 4,381,206 | 4/1983 | Grant et al. | 149/22 |

*Primary Examiner*—Charles T. Jordan
*Assistant Examiner*—John R. Hardee
*Attorney, Agent, or Firm*—Freddie M. Bush; Hugh P. Nicholson

[57] ABSTRACT

A gas generator propellant formulation suitable for use in an air turbo rocket (ATR) which employs an air breathing system that uses fuel gases produced by a gas generator propellant to operate the engine's turbine is provided which can also be used with other airbreathing propulsion systems that require a high gravimetric heating value (GHV). The basic fuel gas generator propellant formulation comprises in weight percent a tetraalkylammonium borohydride 50–100; lithium nitrate 0–50; and optional additives of hydroxy proply cellulose 0–20 and silica or silicon 0–20. The basic fuel gas propellant formulation can also employ an encapsulated tetraalkylammonium borohydride which employs an encapsulation polymer selected from the group consisting of polyethylene, polypropylene, and ethyl cellulose. When employing an encapsulated tetraalkylammonium borohydride a binder is employed selected from the group consisting of polybutadiene and polyether cured with 0.50% selected from hexamethylene diisocyanate and isophorene diisocyanate. The encapsulated fuel gas generator propellant formulation comprises an encapsulated tetraalkylammonium borohydride 50%; binder 0–45%; and lithium nitrate 5%. Lithium nitrate in the fuel gas generator propellant formulation enables the composition to be ignited with a hot wire. The tetraalkylammonium borohydride is selected from the group of tetraalkylammonium borohydrides consisting of tetramethylammonium borohydride, tetraethylammonium borohydride tetrapropylammonium borohydride, and tetrabutylammonium borohydride.

6 Claims, No Drawings

FUEL GAS GENERATOR FOR AIRBREATHING PROPULSION SYSTEMS

DEDICATORY CLAUSE

The invention described herein may be manufactured, used, and licensed by or for the Government for governmental purposes without the payment to us of any royalties thereon.

BACKGROUND OF THE INVENTION

An air turbo rocket (ATR) is an air breathing propulsion system that uses fuel gases produced by a gas generator propellant to operate the engine's turbine. The turbine expands these hot gases and provides energy to the compressor. The compressor then compresses the air from the air inlet and the air flows from the compressor to the combustion chamber. The fuel gases flow from the turbine to the combustion chamber where they react with the compressed air. The combustion gases from the combustion chamber are expanded through a nozzle that produces the rocket's thrust.

A turbojet is an air breathing propulsion system that uses the gases produced in the combustion chamber to operate the engine's turbine. The turbine expands the gases produced in the combustion chamber and provides energy to the compressor. The compressor then compresses the air and the air flows to the combustion chamber. Fuel is injected into the combustion chamber where it reacts with the compressed air. The combustion gases go through the turbine and to a nozzle where the gases are expanded to provide thrust for the rocket.

The ATR has several advantages over the turbojet propulsion system. Since there is no turbomachinery located downstream of the combustion chamber, the ATR can operate at higher combustion temperatures. The ATR can operate at higher speeds because the turbine temperature is independent of air inlet conditions. At subsonic conditions, where the air is not compressed much because of the lower rocket velocity, the ATR operates with better performance since the energy supplied by the turbine is independent of air inlet conditions.

The use of an ATR in a tactical weapon system has not been considered because of limitations in present gas generator formulations. The ATR has not been able to compete with the turbojet propulsion system because the turbojet uses a liquid fuel, JP-10, which has a gravimetric heating value (GHV) of approximately 18,000 btu/lb whereas gas generator propellants for the ATR have GHVs between 5,000 to 9,000 btu/lb.

The object of this invention is to provide a gas generator formulation that can provide enough energy for an ATR turbine but also have a GHV of 18,600 btu/lb.

Another object of this invention is to provide a gas generator formulation that can be used with other airbreathing propulsion systems that require fuel gases with a high GHV.

Further exploitation of this invention is the use of a gas generator propellant formulation in a pulse detonation engine (PDE). A PDE is essentially a shock tube into which both a fuel gas and air is introduced before an ignition device detonates the explosive mixture of gases. The PDE engine is throttled by varying the gaseous flow rates. This engine has a significant weight advantage over the ATR or turbojet because is has no turbomachinery. This engine can also be made of lower cost materials that do not have the high temperature requirements of a turbojet turbine.

Therefore a further object of this invention is to provide a family of gas generators that can be used with airbreathing engines such as the ATR and PDE. The ATR goal is to provide enough energy for an ATR turbine but also have a GHV of 18,600 btu/lb. The PDE goal is to provide an effluent with a GHV of 18,600 btu/lb. but also have good detonation properties.

SUMMARY OF THE INVENTION

A gas generator propellant formulation that is comprised of 95% of a tetraalkylammonium borohydride and 5% lithium nitrate can be ignited with a hot wire igniter. This will cause the formulation to decompose and liberate gases and form a solid klinker. Experiments have been performed to determine the gas yield from the tetraalkylammonium borohydride, tetramethylammonium borohydride, which produces equal amounts of hydrogen and nitrogen gases with the balance of gas produced being methane. Seventy percent of the weight of the original propellant formulation produced gases while 30% of the original propellant formulation remained as a klinker. Chemical analysis decomposition. Seventy percent of the weight of the original propellant will be the liberated gases while 30% of the original propellant will be the weight of the klinker. Chemical analysis of the gases indicates that the gases are 65% methane, 17.5% hydrogen, and 17.5% nitrogen by weight. Measurements of the gas temperature indicates a temperature of 567° F. The GHV of the gases is 18,600 btu/lb based on the chemical analysis of the effluent indicates that the gases are 65% methane, 17.5% hydrogen, and 17.5% nitrogen by weight. The temperature of the effluent was 567° F. The GHV of the effluent is 18,600 btu/lb. The propellant grain is formed by pressing the powdered ingredients. When the grain is pressed into a pellet form and is ignited, the klinker retains the shape of that the unreacted pellet. Since this propellant would be used with a filter system, a propellant that produces a klinker in the shape of the original pellet would require less filtration. This propellant formulation is not chemically compatible with urethane cure methods. When a urethane cure was attempted with this formulation the binder did not harden thereby resulting in a grain having very weak physical properties.

DESCRIPTION OF THE PREFERRED EMBODIMENT

This fuel gas generator propellant formulation can be utilized in an ATR, ducted rocket or pulse detonation engine propulsion system. It can also be used in any airbreathing propulsion system that requires a fuel that has a high GHV. A minor amount of other oxidizers (e.g., potassium nitrate, sodium nitrate, ammonium nitrate, or ammonium perchlorate) is required to maintain the decomposition. The basic formulation is comprised of 0–50% lithium nitrate and 50–100% tetraalkylammonium borohydride. The amount of lithium nitrate can be higher than 5% if gas temperatures above 600° F. were required. The tetraalkylammonium borohydride can be selected from the group of tetraalkylammonium borohydrides consisting of tetramethylammonium borohydride, tetraethylammonium borohydride, tetrapropylammonium borohydride, and tetrabutylammonium borohydride. Experimental results indicates a decrease in the amount of hydrogen and nitrogen and a corresponding increase in the amount of the other gaseous component i.e., ethane, propane, and butane, increases as the molecular weight of the tetraalkylammonium borohydride increases. Based on the experimental results obtained, tetramethylammonium borohydride is preferred for maximum decomposition rate which is achieved in proportion to the amount of nitrogen gas effluent. If the propellant is in the form of pressed pellets, 0–20% hydroxy propyl cellulose is added to improve the physical properties of the pellet. Also 0–20% of additives selected from silica, or silicon to increase the strength of the klinker can be added to the formulation. The formulation could have a binder such as hydroxy terminated polybutadiene if the tetramethylammonium borohydride were encapsulated in another thermoplastic polymer such as polyethylene, polypropylene or ethyl cellulose. The binder could be 0–50% of the formulation and could be either polybutadiene or polyether cured with hexamethylene diisocyanate or isophorone diisocyanate could be 0.50% of the formulation and could be either polybutadiene or polyether cured with hexamethylene diisocyanate or isophorone diisocyanate.

Example I: Basic Fuel Gas Generator Propellant Formulation

| Ingredient | Weight Percent |
|---|---|
| Example I: Basic Fuel Gas Generator Propellant Formulation | |
| Tetramethylammonium borohydride | 50–100% |
| Lithium Nitrate | 0–50% |
| Optional additives: | |
| Hydroxy propyl cellulose | 0–20% |
| Silica or silicon | 0–20% |
| Example II: Basic Encapsulated Fuel Gas Generator Propellant Formulation | |
| Encapsulated tetramethylammonium borohydride* | 50% |
| Binder for encapsulated tetramethylammonium borohydride** | 0–45% |
| Lithium nitrate*** | 5% |

*Encapsulation polymer selected from the group consisting of polyethylene, polypropylene, or ethyl cellulose
**Binder for encapsulated tetramethylammonium borohydride selected from the group consisting of polybutadiene and polyether cured with 0.50% hexamethylene diisocyanate or isophorone diisocyanate.
***To enable ignition to be achieved with a hot wire.

We claim:

1. A gas generator propellant formulation comprising tetraalkylammonium borohydride in an amount from about 50–100 weight percent and lithium nitrate in an amount from about 0–50 weight percent, said gas generator propellant formulation pressed into pellet form and when ignited, produces effluent comprising an alkane, hydrogen, and nitrogen and forms a klinker in the shape and appearance of said original pellet form, said tetraalkylammonium borohydride selected from the group tetraalkylammonium borohydrides consisting of tetramethylammonium borohydride, tetraethylammonium borohydride, tetrapropylammonium borohydride, and tetrabutylammonium borohydride.

2. The gas generator propellant formulation as defined in claim 1 wherein said tetraalkylammonium borohydride is tetramethylammonium borohydride and wherein said effluent produced comprises said alkane which is methane in an amount of about 65%, said hydrogen in an amount of about 17.5%, and said nitrogen in an amount of about 17.5%.

3. The gas generator propellant formulation as defined in claim 2 and additionally comprising hydroxyl propyl cellulose as an optional ingredient in an amount from about 0–20 weight percent to improve physical properties of said original pellet form and an additional optional additive in an amount from about 0–20 weight percent selected from the group consisting of silica and silicon to increase the strength of said klinker.

4. The gas generator propellant formulation as defined in claim 3 which comprises said tetramethylammonium borohydride in an amount of about 95 weight percent and said lithium nitrate in an amount of about 5 weight percent.

5. The gas generator propellant formulation as defined in claim 1 wherein said tetraalkylmmonium borohydride is encapsulated with an encapsulation polymer selected from the group consisting of polyethylene, polypropylene, or ethyl cellulose and wherein said encapsulated tetraalkylammonium borohydride additionally comprises a binder selected from the group consisting of hydroxy-terminated polybutadiene and hydroxy-terminated polyether, said binder cured with 0.50% hexamethylene diisocyanate or isophorone diisocyanate.

6. The gas generator propellant formulation as defined in claim 5 wherein said encapsulated tetramethylammonium borohydride is tetramethylammonium borohydride which is present in an amount of about 50 weight percent; said binder which is present in an amount of about 45 weight percent; and said lithium nitrate which is present in an amount of about 5 weight percent.

* * * * *